US008161778B1

(12) United States Patent
Ma

(10) Patent No.: US 8,161,778 B1
(45) Date of Patent: Apr. 24, 2012

(54) CARD LOCK AND KEY LOCK ASSEMBLY

(76) Inventor: Sheng-Chueh Ma, Changhua County (TW)

( * ) Notice: Subject to any disclaimer, the term of this patent is extended or adjusted under 35 U.S.C. 154(b) by 0 days.

(21) Appl. No.: 13/177,047

(22) Filed: Jul. 6, 2011

(51) Int. Cl.
*E05B 35/08* (2006.01)

(52) U.S. Cl. ..... 70/21; 70/71; 70/68; 70/284; 70/285; 70/432; 70/DIG. 9; 70/DIG. 59; 70/DIG. 63; 70/337

(58) Field of Classification Search ..... 70/21, 71, 70/68, 284, 285, 352, 432, DIG. 9, DIG. 63, 70/DIG. 59, 337
See application file for complete search history.

(56) References Cited

U.S. PATENT DOCUMENTS 4,416,126 A * 11/1983 Remington ..... 70/71
5,557,954 A * 9/1996 Ling ..... 70/68
5,689,979 A * 11/1997 Yu ..... 70/68
5,927,110 A * 7/1999 Yu ..... 70/68
6,065,313 A * 5/2000 Huang ..... 70/68
6,202,455 B1 * 3/2001 Su ..... 70/68
6,807,832 B1 * 10/2004 Jeng ..... 70/68
6,912,880 B2 * 7/2005 Ling et al. ..... 70/71
7,415,853 B2 * 8/2008 Yu ..... 70/284
7,568,367 B2 * 8/2009 Huang ..... 70/DIG. 63
2006/0254329 A1 * 11/2006 Yu ..... 70/284
* cited by examiner

*Primary Examiner* — Lloyd Gall
*Assistant Examiner* — David E Sosnowski
(74) *Attorney, Agent, or Firm* — Browdy and Heimark, PLLC

(57) ABSTRACT

A card lock and key lock assembly includes a housing, a lock latch movably disposed in the housing, a swivel member pivoted to the housing and having a block portion stoppable against the lock latch, a card key lock disposed in the housing and having a lifting plate, a rotating shaft, and a hook plate connected with the lifting plate and engagable with the rotating shaft for driving the rotating shaft to rotate when the lifting plate is moved downwards, such that the rotating shaft is stoppable against the swivel member for driving the block portion of the swivel member to move away from the lock latch, and a pin tumbler lock disposed in the housing and having a plug with an arm portion for driving the block portion of the swivel member to move away from the lock latch when the plug is rotated to an unlocked position.

5 Claims, 6 Drawing Sheets

CARD LOCK AND KEY LOCK ASSEMBLY

BACKGROUND OF THE INVENTION

1. Field of the Invention

The present invention relates generally to locks and more specifically, to a card lock and key lock assembly that includes two types of lock units, so that a user can selectively operate one of the two lock units to open the card lock and key lock assembly.

2. Description of the Related Art

Conventional locks generally include two types, i.e. a key controlled type, which needs a correct key to unlock it, such as a pin tumbler lock, a magnetic lock or a card key lock, and a combination controlled type, which needs a correct permutation of the numbers or symbols to unlock it, such as a single- or multiple-dial lock, or a letter or number combination lock.

However, if a user loses the correct key of a key controlled lock, the user will be unable to open the lock and may have to break the lock or ask a locksmith for help. If the user forgets the correct permutation of the numbers or symbols of a combination controlled lock, the user will encounter the same problem.

SUMMARY OF THE INVENTION

The present invention has been accomplished in view of the above-noted circumstances. It is therefore one objective of the present invention to provide a card lock and key lock assembly, which has two types of lock units such that a user can open the card lock and key lock assembly by selectively operating one of the two lock units, thereby enhancing convenience in use.

To achieve this objective of the present invention, the card lock and key lock assembly comprises a housing having a chamber, a lock notch in communication with the chamber, and a pin tumbler lock hole in communication with the chamber. A lock latch is movably mounted in the housing and has a post movable in and out of the lock notch of the housing, and a spring stopped against the post to support the post in the lock notch. A swivel member is pivotally mounted in the housing so as to be pivotable between a first angular orientation where a first block portion of the swivel member is stopped against the lock latch for prohibiting the movement of the lock latch, and a second angular orientation where the first block portion is moved away from the lock latch for allowing the movement of the lock latch. A card key lock is disposed in the housing, including a lifting plate moveable upwards and downwards, a rotating shaft having a teeth portion and a claw portion, and a hook plate connected with one side of the lifting plate and engagable with the teeth portion of the rotating shaft when the lifting plate is moved downwards for driving the rotating shaft to rotate in such a way that the claw portion of the rotating shaft is stoppable against a second block portion of the swivel member for driving the swivel member to turn to the second angular orientation. A pin tumbler lock has a casing mounted in the pin tumbler lock hole of the housing, and a plug rotatably disposed in the casing and provided with an arm portion stoppable against a third block portion of the swivel member for driving the swivel member to turn to the second angular orientation when the plug is rotated to an unlocked position. Accordingly, the card lock and key lock assembly can be opened by operating either the card key lock or the pin tumbler lock.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
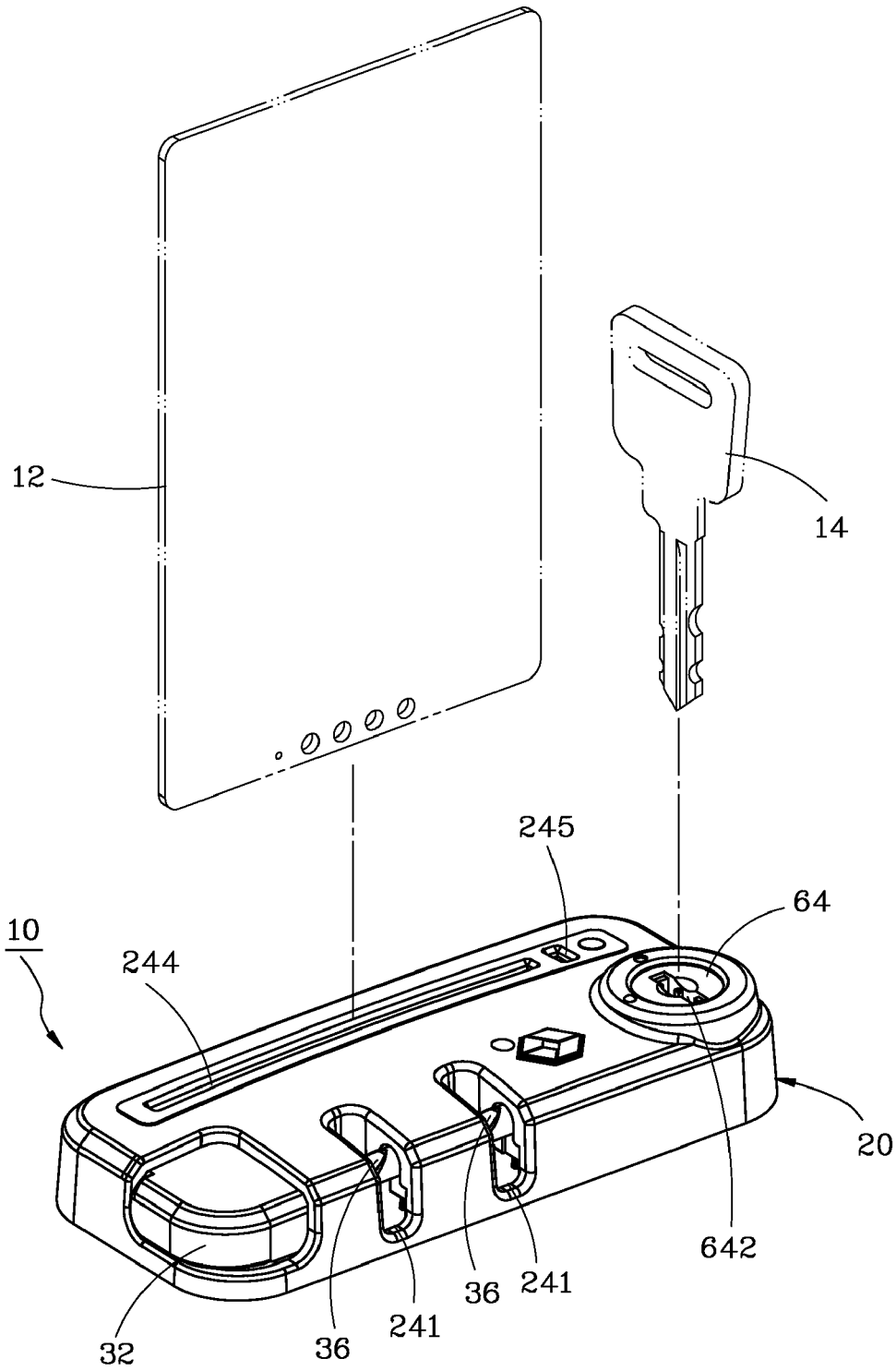
FIG. 1 is a perspective view of the card lock and key lock assembly according to a preferred embodiment of the present invention.
Figure 2:
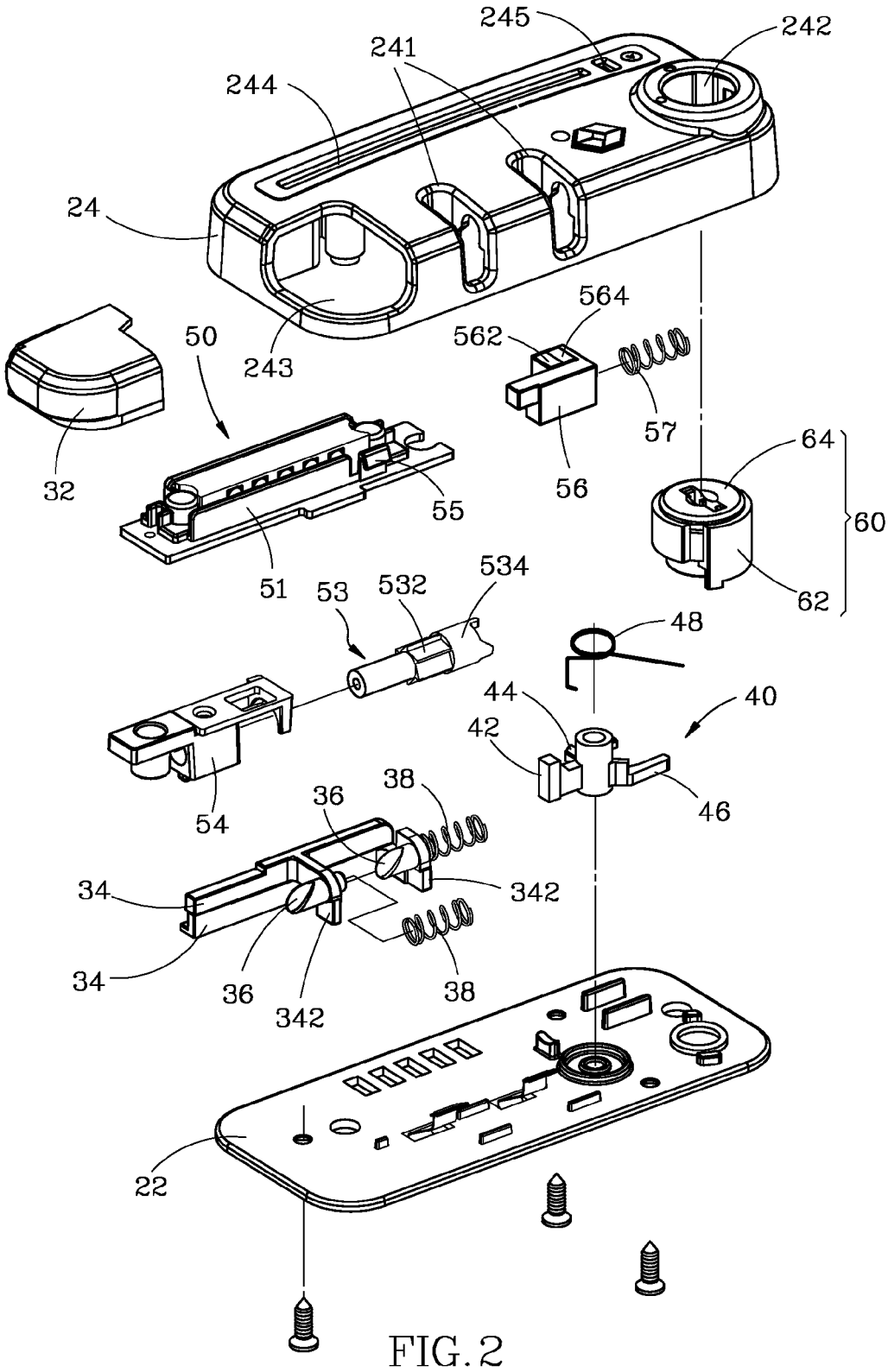
FIG. 2 is an exploded view of the card lock and key lock assembly according to the preferred embodiment of the present invention.
Figure 4:
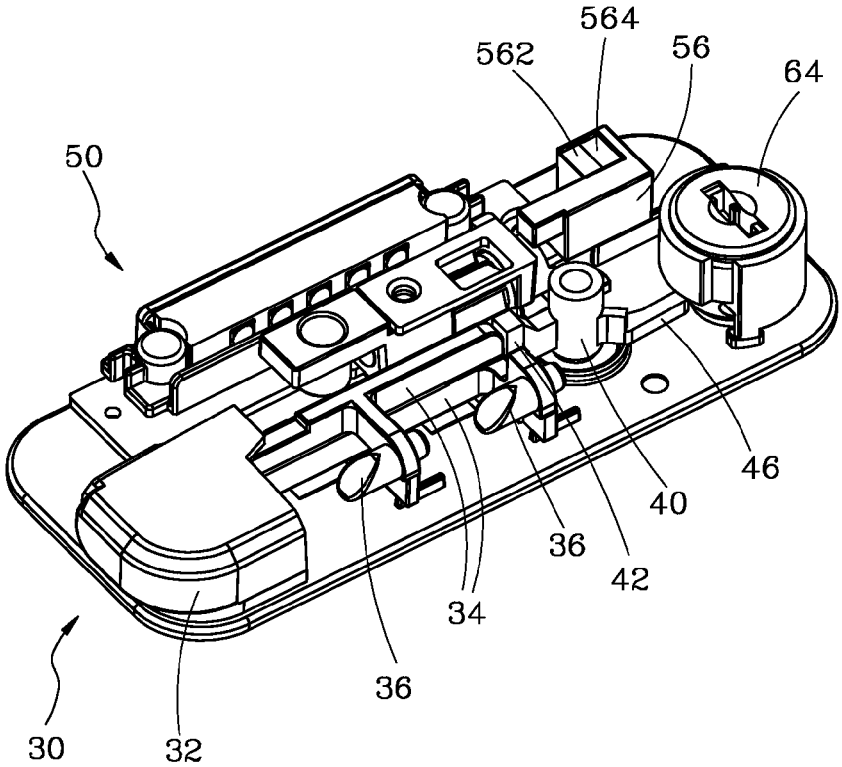
FIG. 4 is another perspective view of the card lock and key lock assembly according to the preferred embodiment of the present invention, in which the cover plate of the housing is removed.
Figure 5:
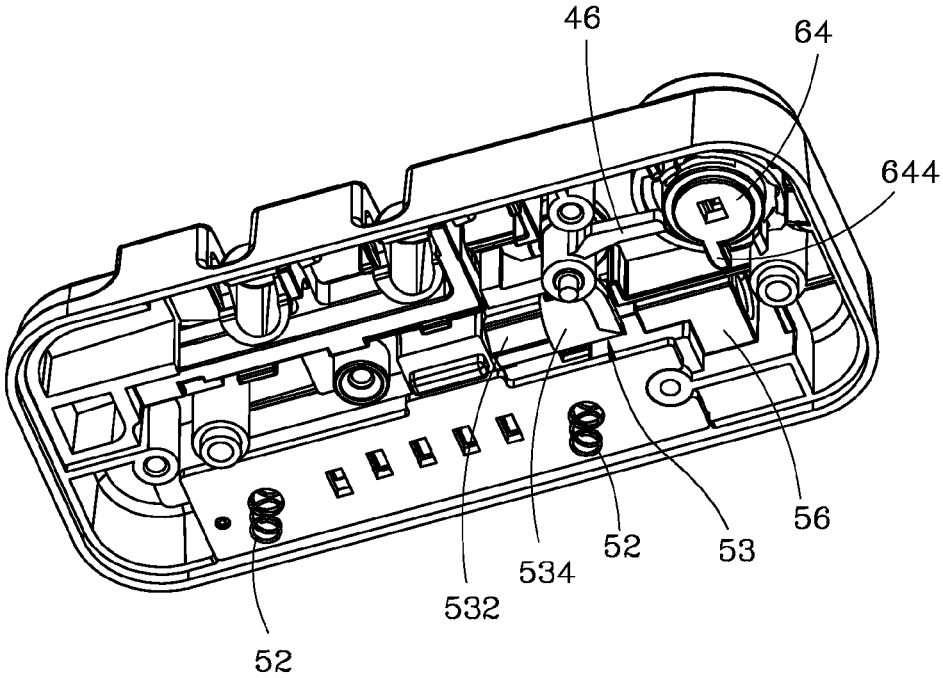
FIG. 5 is still another perspective view of the card lock and key lock assembly according to the preferred embodiment of the present invention, in which the bottom plate of the housing is removed.

As shown in FIGS. 1, 2 and 4, a card lock and key lock assembly 10 in accordance with a preferred embodiment of the present invention comprises a housing 20, a lock latch 30, a swivel member 40, a card key lock 50, and a pin tumbler lock 60.

Figure 3:
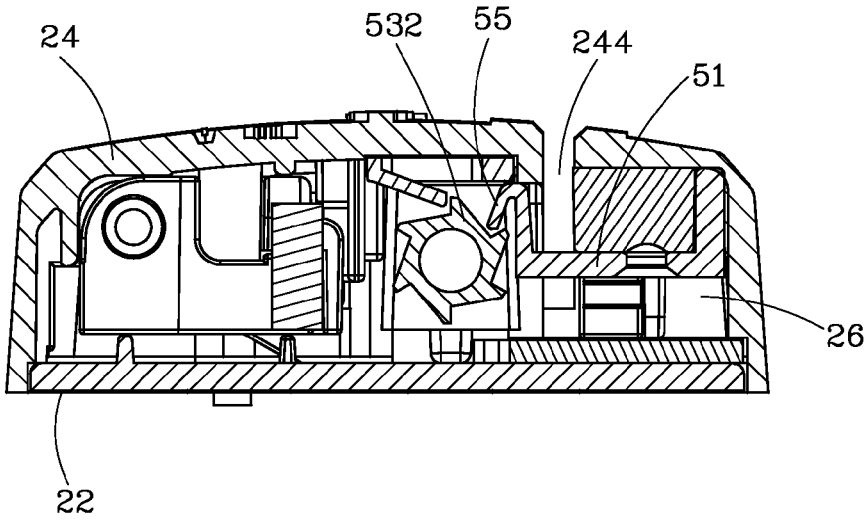
FIG. 3 is a sectional view of the card lock and key lock assembly according to the preferred embodiment of the present invention.

The housing 20 includes a bottom plate 22 and a cover plate 24 coved on the top side of the bottom plate 22 to define with the bottom plate 22 a chamber 26 therebetween, as shown in FIG. 3. The cover plate 24 has two spaced lock notches 241 in communication with the chamber 26 for receiving two pull-tabs of a zipper (not shown), a pin tumbler lock hole 242 in communication with the chamber 26, an opening 243 in communication with the chamber 26, a slot 244 in communication with the chamber 26 for insertion of a keycard 12, and a window 245 in communication with the chamber 26.

Figure 6:
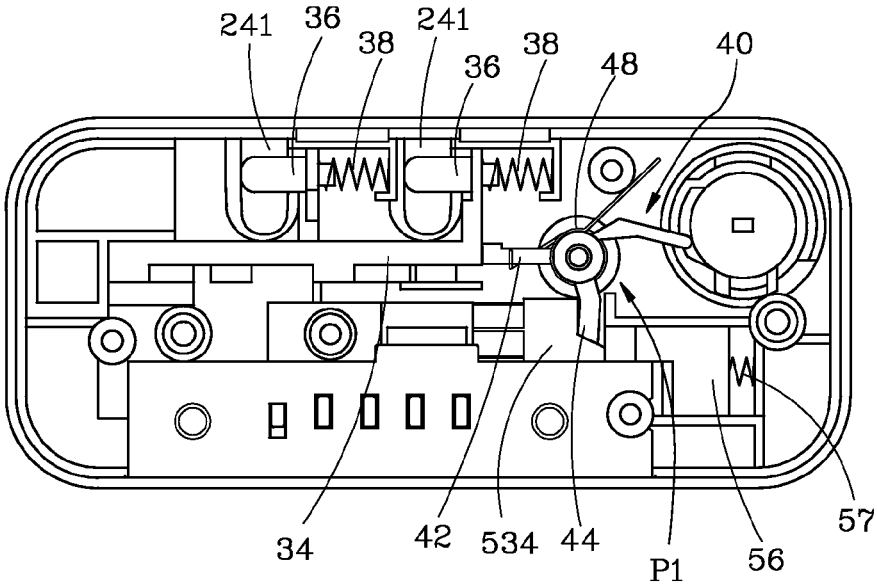
FIG. 6 is a bottom plan view of the card lock and key lock assembly according to the preferred embodiment of the present invention, in which the bottom plate of the housing is remove for showing that the swivel member is turned to a first angular orientation.
Figure 8:
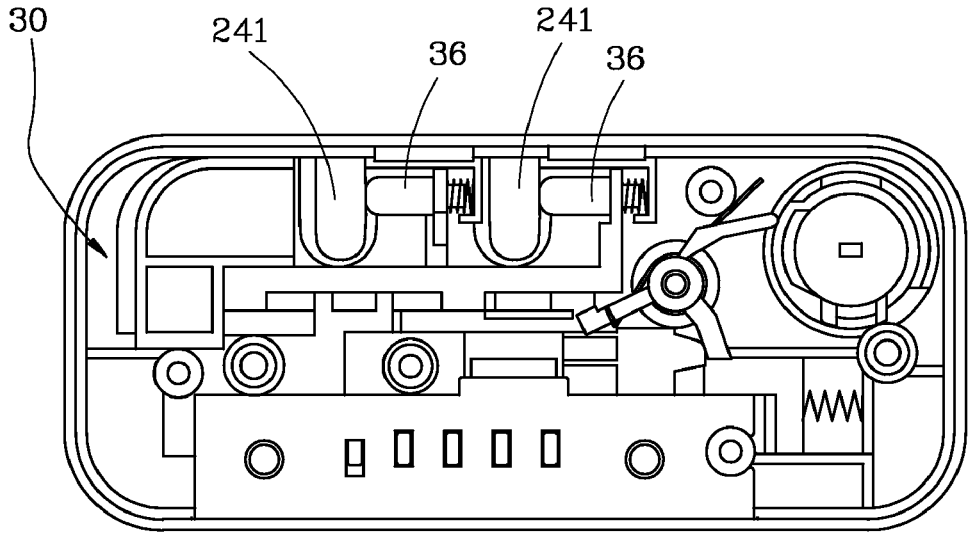
FIG. 8 is similar to FIG. 7, but showing the posts of the lock latch are moved out of the lock notches of the housing.
Figure 10:
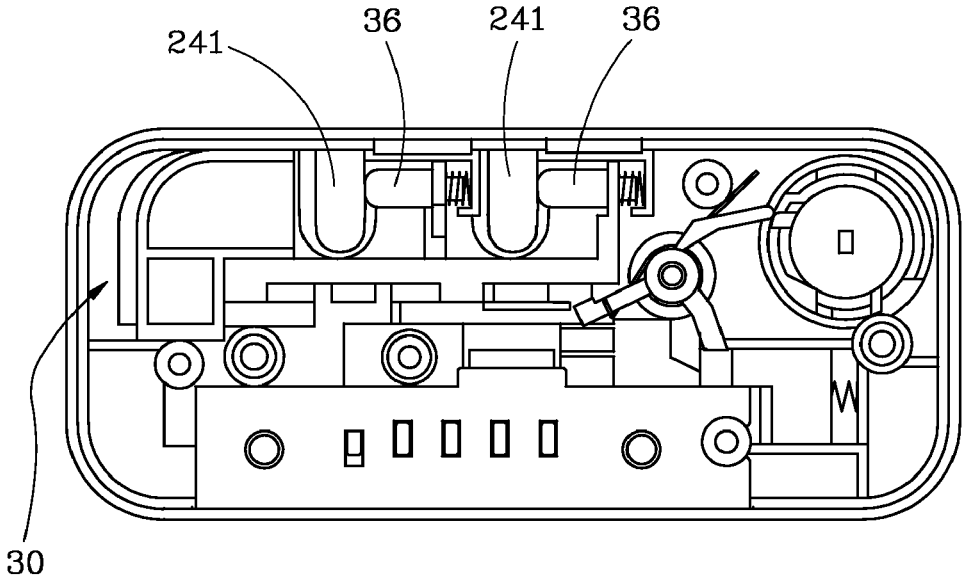
FIG. 10 is similar to FIG. 9, but showing the posts of the lock latch are moved out of the lock notches of the housing.

The lock latch 30 is movably mounted in the housing 20, including a push button 32 received in the opening 243, two rods 34 inserted into the push button 32 and each having an extension wall 342, two posts 36 respectively connected with the extension walls 342 of the rods 34 and movable in and out of the lock notches 241 along with the movement of the push button 32 to lock and unlock the pull-tabs of the zipper, as shown in FIGS. 6, 8 and 10, and two springs 38 respectively stopped against the posts 36 to support the posts 36 in the lock notches 241.

Figure 7:
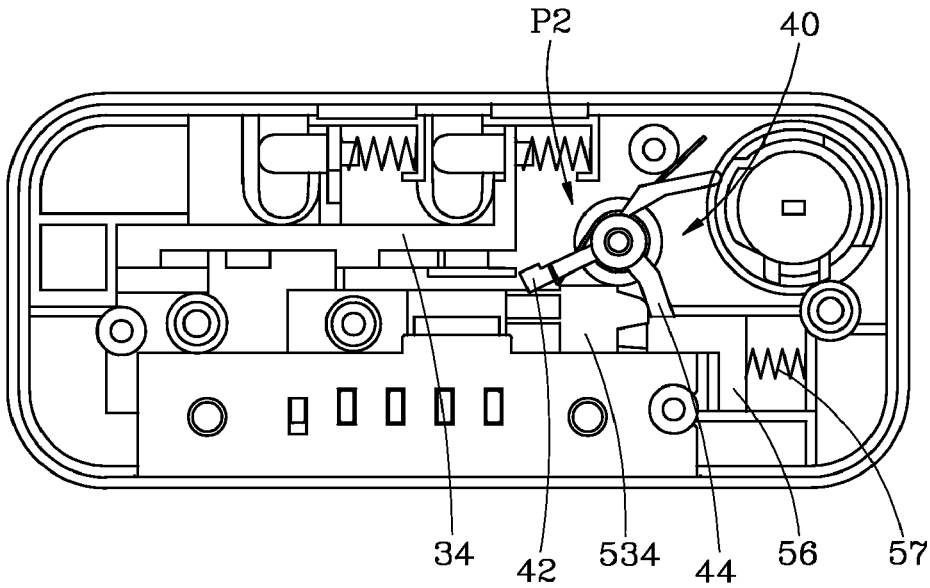
FIG. 7 is similar to the FIG. 6, but showing the swivel member is turned to a second angular orientation.
Figure 9:
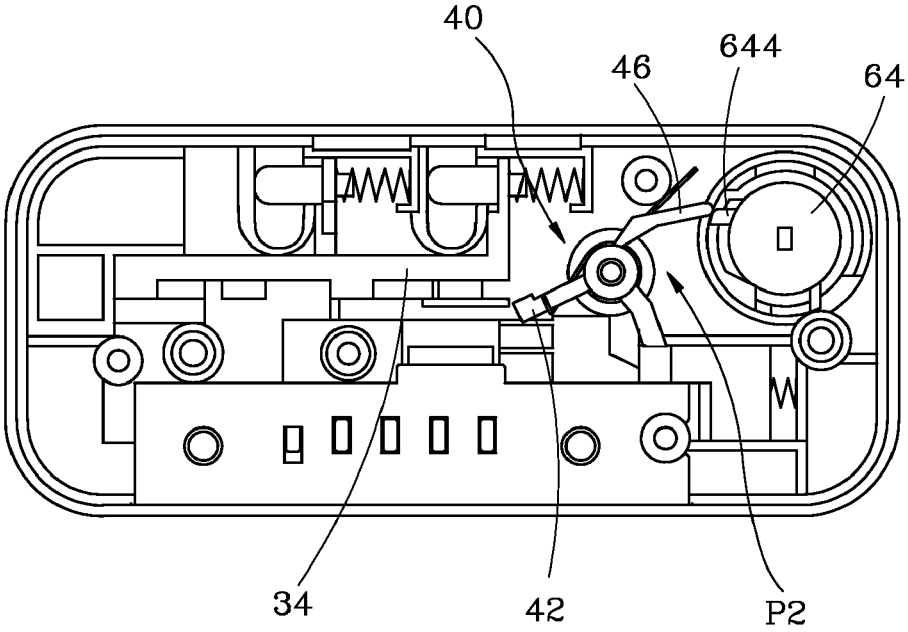
FIG. 9 is a bottom plan view of the card lock and key lock assembly according to the preferred embodiment of the present invention, wherein the bottom plate is removed for showing that the plug is rotated to the unlocked position.

The swivel member 40 is pivotally mounted in the housing 20 by means of a center post thereof. The swivel member 40 further includes a first block portion 42, a second block portion 44 and a third block portion 46, which are circumferentially arranged around the circumference of the center post. The swivel member 40 is normally stayed at a first angular orientation P1, as shown in FIG. 6, where the first block portion 42 of the swivel member 40 is stopped against the rods 34 of the lock latch 30 for prohibiting the movement of the lock latch 30. When the swivel member 40 is forced to turn to a second angular orientation P2, as shown in FIGS. 7 and 9, the first block portion 42 of the swivel member 40 is moved away from the rods 34 of the lock latch 30 for allowing the movement of the lock latch 30, as shown in FIGS. 8 and 10. Further, a torsion spring 48 is attached to the swivel member 40 for keeping the swivel member 40 in the first angular orientation P1 in a normal status.

As shown in FIGS. 2 to 5, the card key lock 50 is disposed in the housing 20, including a lifting plate 51 drivenable by the keycard 12 to move downwards, two springs 52 stopped against the lift plate 51 to push the lifting plate 51 upwards, a rotating shaft 53 rotatably inserted into a retaining base 54 and provided with a teeth portion 532 and a claw portion 534, and a hook plate 55 integrally connected with one side of the lifting plate 51. When the lifting plate 51 is forced to move downwards, the hook plate 55 will engage and push the teeth portion 532 of the rotating shaft 53 so as to drive the rotating shaft 53 to rotate at a predetermined angle. At the same time, one of the distal ends of the claw portion 534 of the rotating shaft 53 will contact the second block portion 44 of the swivel member 40 and then drive the swivel member 40 to turn to the second angular orientation P2, as shown in FIG. 7. Additionally, a visually accessible member 56 is movably mounted in the housing 20 and has two different color zones 562 and 564. The color zone 562, which is embodied as a red color zone, indicates the locked condition of the card key lock 50, and the color zone 564, which is embodied as a blue color zone, indicates the unlocked condition of the card key lock 50. Further, a spring 57 is disposed in the housing 20 and stopped against the visually accessible member 56 to push the visually accessible member 56 toward the rotating shaft 53 for showing one of the color zones 562 and 564 through the window 245, as shown in FIGS. 2 and 7.

The pin tumbler lock 60 includes a casing 62 mounted in the pin tumbler lock hole 242 of the housing 20, and a plug 64 rotatably disposed in the casing 62. The plug 64 has a keyway 642 at the top end thereof for insertion of a key 14, as shown in FIG. 1, and an arm portion 644 extending from the bottom side thereof. When the swivel member 40 is stayed at the first angular orientation P1 and the plug 64 is rotated to an unlocked position, the arm portion 644 of the plug 64 will contact and then push the third block portion 46 of the swivel member 40 to move during the rotation motion of the plug 64, resulting in that the swivel member 40 will be turned to the second angular orientation P2, as shown in FIG. 9.

By means of aforesaid design, when a user inserts a correct keycard 12 into the slot 244 of the housing 20 and presses the lifting plate 51 downwards, the rotating shaft 53 is rotated through the engagement of the hook plate 55 and the teeth portion 532 of the rotating shaft 53, such that the swivel member 40 can be forced by the claw portion 534 of the rotating shaft 53 to turn to the second angular orientation P2, as shown in FIG. 7, and meanwhile the visually accessible member 56 can be pushed by the spring 57 to a position where the color zone 564 is visible through the window 245. Thereafter, the user can move the posts 36 out of the lock notches 241 by pushing the push button 32, as shown in FIG. 8, so as to unlock the pull-tabs of the zipper.

When the user wants to lock the pull-tabs of the zipper, the user can insert the pull-tabs of the zipper into the lock notches 241 of the housing 20 for enabling the pull-tabs of the zipper to be inserted therethrough the posts 36 of the lock latch 30, and then the user can insert the keycard 12 into the slot 244 of the housing 20 again to press the lifting plate 51 downwards. As soon as keycard 12 is inserted into the slot 244, the rotating shaft 53 will be driven to rotate in such a way that the distal end of the claw portion 534 of the rotating shaft 53 will be moved away from the second block portion 44 of the swivel member 40, as shown in FIG. 6, such that the swivel member 40 will be driven by the torsion spring 48 to turn to the first angular orientation P1, and meanwhile the visually accessible member 56 will be pushed by another distal end of the claw portion 534 of the rotating shaft 53 to a position where the color zone 562 is visible through the window 245. At the same time, the pull-tabs of the zipper will be locked to the lock notches 241 of the housing 20.

Besides, the user can use the key 14 to unlock the pull-tabs of the zipper. In this case, the user may inset the key 14 into the keyway 642 of the plug 64 and then rotate the plug 64 to the unlock position, enabling the arm portion 644 of the plug 64 to push the third block portion 46 of the swivel member 40, as shown in FIG. 9. In this way, the swivel member 40 can be turned to the second angular orientation P2, and therefore the user can unlock the pull-tabs of the zipper by pushing the push button 32 of the lock latch 30, as shown in FIG. 10. In conclusion, the user can open the card lock and key lock assembly 10 by using either the card key lock 50 or the pin tumbler lock 60.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A card lock and key lock assembly comprising:

a housing having a chamber, a lock notch in communication with the chamber, and a pin tumbler lock hole in communication with the chamber;

a lock latch movably mounted in the housing and having a post movable in and out of the lock notch of the housing, and a spring stopped against the post to support the post in the lock notch;

a swivel member pivotally mounted in the housing and having a first block portion, a second block portion, and a third block portion, the swivel member being turnable between a first angular orientation where the first block portion is stopped against the lock latch for prohibiting the movement of the lock latch, and a second angular orientation where the first block portion is moved away from the lock latch for allowing the movement of the lock latch;

a card key lock disposed in the housing and including a lifting plate moveable upwards and downwards, a rotating shaft having a teeth portion and a claw portion, and a hook plate connected with one side of the lifting plate and engagable with the teeth portion of the rotating shaft when the lifting plate is moved downwards for driving the rotating shaft to rotate in a way that the claw portion of the rotating shaft is stoppable against the second block portion of the swivel member for driving the swivel member to turn to the second angular orientation; and a pin tumbler lock having a casing mounted in the pin tumbler lock hole of the housing, and a plug rotatably disposed in the casing and provided with an arm portion stoppable against the third block portion of the swivel member for driving the swivel member to turn to the second angular orientation when the plug is rotated to an unlocked position.

2. The card lock and key lock assembly as claimed in claim 1, further comprising a torsion spring attached to the swivel member for keeping the swivel member in the first angular orientation.

3. The card lock and key lock assembly as claimed in claim 1, wherein the claw portion of the rotating shaft is stoppable against a visually accessible member movably mounted in the housing and having two different color zones, one of which indicates the locked condition of the card key lock and the other of which indicates the unlocked condition of the card key lock; a spring is disposed in the housing and stopped against the visually accessible member to push the visually accessible member toward the rotating shaft for showing one of the color zones.

4. The card lock and key lock assembly as claimed in claim 1, wherein the rotating shaft is rotatably inserted into a retaining base.

5. The card lock and key lock assembly as claimed in claim 1, wherein the lock latch includes a push button, and a rod inserted into the push button and having an extension wall for connection of the post.

* * * * *